US007232103B2

(12) United States Patent
Heath

(10) Patent No.: US 7,232,103 B2
(45) Date of Patent: Jun. 19, 2007

(54) LOAD-BEARING PRESSURIZED LIQUID COLUMN

(75) Inventor: Roland B. Heath, Vernal, UT (US)

(73) Assignee: Efficient Mining Systems LLC, Vernal, UT (US)

( * ) Notice: Subject to any disclaimer, the term of this patent is extended or adjusted under 35 U.S.C. 154(b) by 200 days.

(21) Appl. No.: 10/976,360

(22) Filed: Oct. 27, 2004

(65) Prior Publication Data

US 2006/0086885 A1 Apr. 27, 2006

(51) Int. Cl.
*F16M 13/00* (2006.01)

(52) U.S. Cl. ..... 248/631; 248/354.1; 248/200.1; 248/636; 248/562; 405/288; 405/289; 52/2.21

(58) Field of Classification Search ..... 248/200.1, 248/602, 644, 636, 631, 562; 52/112, 632; 188/298, 313, 297; 299/11; 405/288, 289
See application file for complete search history.

(56) References Cited

U.S. PATENT DOCUMENTS 1,752,101 A 3/1930 Meutsch
2,990,166 A 6/1961 Walsh
3,565,398 A * 2/1971 James et al. ..... 254/93 HP
3,695,582 A * 10/1972 Clay ..... 254/93 HP
3,799,504 A * 3/1974 Vaughen ..... 254/93 HP
4,052,029 A * 10/1977 Townsend ..... 248/548
4,072,015 A 2/1978 Morrell et al.
4,143,854 A 3/1979 Vetter
4,167,361 A 9/1979 Petro et al.
4,185,940 A * 1/1980 Spies ..... 405/288
4,277,204 A 7/1981 Koppers et al.
4,522,537 A 6/1985 Kuck
4,560,145 A * 12/1985 Widmer ..... 254/93 HP
4,655,008 A 4/1987 Parish
4,712,947 A * 12/1987 Thom ..... 405/288
4,983,077 A 1/1991 Sorge et al.
5,143,340 A 9/1992 Wood et al.
5,178,367 A * 1/1993 Vaughen ..... 254/93 HP
5,308,196 A 5/1994 Frederick
5,348,425 A * 9/1994 Heiliger ..... 405/297
5,546,707 A 8/1996 Caruso
5,615,979 A 4/1997 Lin
5,669,739 A * 9/1997 Clarke ..... 299/11
5,921,718 A * 7/1999 Kolk ..... 405/290
6,056,480 A * 5/2000 Kolk ..... 405/288
6,196,635 B1 * 3/2001 Rohaly et al. ..... 299/11

(Continued)

*Primary Examiner*—Carl Friedman
*Assistant Examiner*—Michael D. McDuffie
(74) *Attorney, Agent, or Firm*—Thorpe North & Western

(57) ABSTRACT

A load-bearing, pressurized-fluid column apparatus and method for supporting a load or mine ceiling with respect to a support surface or mine floor includes an elongated, flexible sleeve and bladder retain a substantially incompressible liquid. The sleeve and bladder have a collapsed and an expanded configuration. In the collapsed configuration, the sleeve and bladder are not filled, and have a first, shorter length. In the expanded configuration, the sleeve and bladder are filled with the liquid, and have a second, longer length sized to extend to and between the load and the support surface. A valve allows the liquid to be added and prevents escape of the liquid. A base can seal a lower end of the sleeve, and can be disposed on the support surface. A cap can seal an upper end of the sleeve, and can be capable of abutting the load.

20 Claims, 4 Drawing Sheets

U.S. PATENT DOCUMENTS 6,394,707 B1 5/2002 Kennedy et al.
6,637,159 B1 10/2003 Heath
2002/0136607 A1 9/2002 Merz

* cited by examiner

LOAD-BEARING PRESSURIZED LIQUID COLUMN

BACKGROUND OF THE INVENTION

1. Field of the Invention

The present invention relates generally to a pressurized liquid, load-bearing structure. More particularly, the present invention relates to column with a longitudinally expandable sleeve to contain a pressurized liquid.

2. Related Art

In mining it is often necessary to support the ceilings of tunnels and cavities to resist collapse. Various different methods have been proposed to prevent ceiling collapse. Traditional methods include wood or steel structures forming a framework to support the ceiling. Such wood or steel structures often become permanent due to the difficulty of removing them. In addition, the transportation of the necessary materials into the mine, and the construction of the framework, is often difficult and time consuming. Cement structures also have been proposed, but are difficult to use because the concrete must cure before accepting loads. In addition, unexpected loads can crush and destroy the forms before the concrete cures.

SUMMARY OF THE INVENTION

It has been recognized that it would be advantageous to develop an improved method and apparatus for supporting loads, such as ceilings in a mine. In addition, it has been recognized that it would be advantageous to develop an expandable and/or collapsible load bearing structure capable of being collapsible for transportation, and expandable for use.

The invention provides a load-bearing, pressurized-fluid column apparatus for supporting a load with respect to a support surface. An elongated, flexible sleeve and a bladder retain a substantially incompressible liquid. The elongated, flexible sleeve has at least two configurations, including a collapsed and an expanded or rigid configuration. In the collapsed configuration, the bladder is not filled, and has a first, shorter length. In the expanded or rigid configuration, the bladder is filled with the liquid, and has a second, longer length sized to extend to and between the load and the support surface. The incompressible liquid is capable of transferring a compressive force of the load to tension load in the sleeve. A valve allows the liquid to be added to the sleeve, and prevents escape of the liquid.

In accordance with a more detailed aspect of the present invention, the sleeve can include two sleeve portions telescopically engaging one another.

In accordance with another more detailed aspect of the present invention, the sleeve can include a flexible, high strength woven fabric to withstand high-tension loads, and the bladder can include a flexible, liquid impervious layer to contain liquid.

In accordance with another more detailed aspect of the present invention, the sleeve has a circular, cylindrical shape in the expanded configuration to withstand tension loads.

In accordance with another more detailed aspect of the present invention, the apparatus further includes a base to abut the support surface, and a cap to abut the load. The sleeve has opposite ends, one end being coupled to the base and the other end being coupled to the cap to form an enclosure to extend to and between the load and the support surface in the expanded configuration.

In accordance with another more detailed aspect of the present invention, at least one of the ends of the sleeves is adjustably coupled to either the cap or the base to selectively adjust the length of the sleeve, and the distance between the cap and the base. A ring can be securable to either the cap or the base. One end of the sleeve can be wrapped around the ring and selectively slid around the ring to adjust the length of the sleeve, and the distance between the cap and the base.

In accordance with another more detailed aspect of the present invention, the apparatus can further include means for limiting longitudinal extension of the sleeve. For example, cables or rods extending between the base and the cap can be used.

In accordance with another more detailed aspect of the present invention, the base and cap can include inner and outer plates with a ring disposed in an annular groove. The ends of the sleeve can extend between the plates and around the ring to retain the ends of the sleeves between the plates.

A method for utilizing the column apparatus for supporting a load with respect to a support surface includes positioning a flexible sleeve and/or bladder in a desired location between the load and the support surface. A substantially incompressible liquid is introduced into the sleeve and bladder to lengthen the sleeve to a length extending to and between the load and the support surface. Escape of the liquid from the sleeve is prevented so that the volume of the sleeve between the load and the support surface is maintained at a substantially constant value so as to resist movement of the load towards the support surface.

In accordance with another more detailed aspect of the present invention, the liquid in the sleeve or bladder can be pressurized.

In accordance with another more detailed aspect of the present invention, the step of introducing a liquid into the sleeve further includes opening a valve. Likewise, the step of preventing escape of the liquid includes closing the valve.

In accordance with another more detailed aspect of the present invention, the step of positioning a sleeve further includes positioning a first plate to abut the support surface. A first end of the sleeve is secured to the first plate so that the first plate seals the first end of the sleeve. A second end of the sleeve is secured to a second plate so that the second plate seals the second end of the sleeve. The second plate is positioned to abut the load.

In accordance with another more detailed aspect of the present invention, the length of the sleeve is adjusted to extend to and between the load and the support surface. An end of the sleeve can be wrapped around a ring.

Additional features and advantages of the invention will be apparent from the detailed description which follows, taken in conjunction with the accompanying drawings, which together illustrate, by way of example, features of the invention.

DETAILED DESCRIPTION

Figure 1:
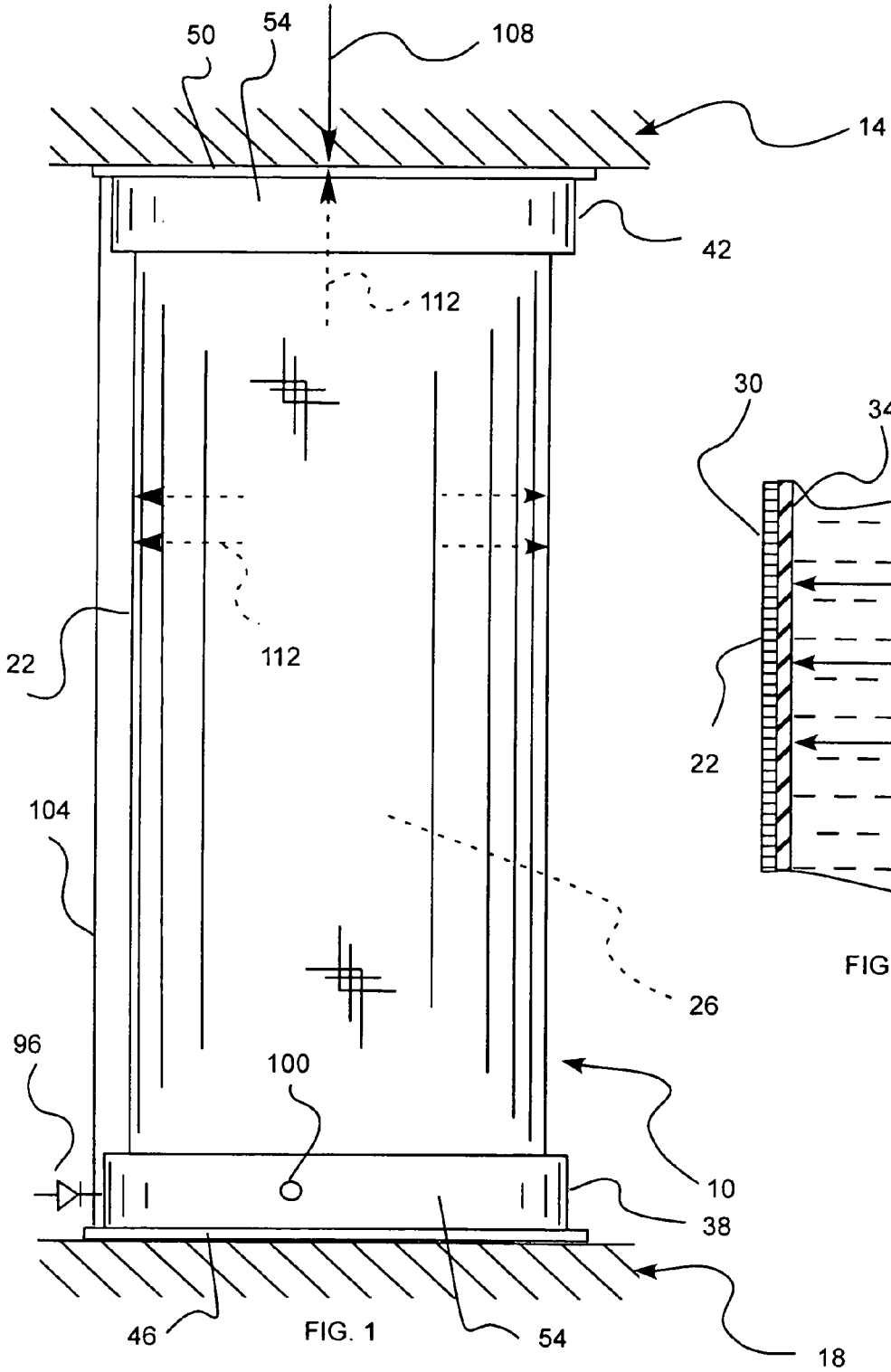
FIG. 1 is a side view of a load-bearing column apparatus in accordance with an embodiment of the present invention shown in an expanded configuration supporting a load.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
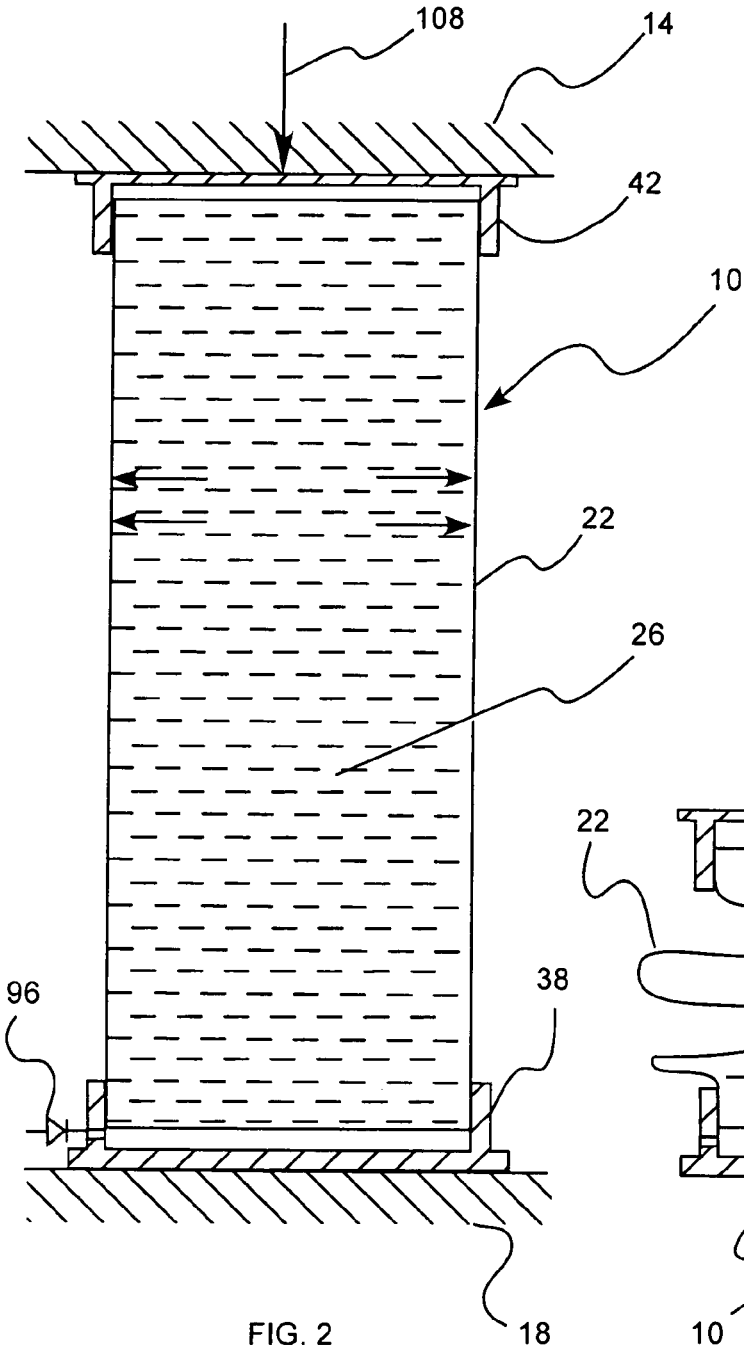
FIG. 2 is a cross-sectional view of the apparatus of FIG. 1.
Figure 3:
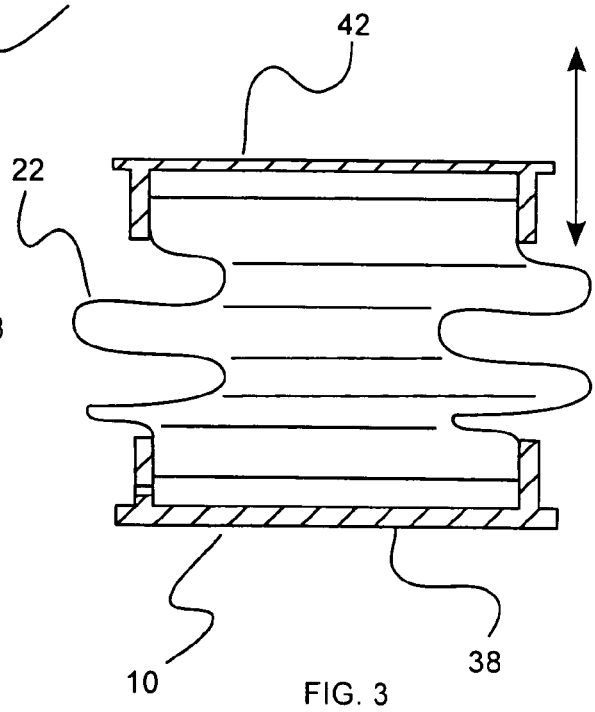
FIG. 3 is a cross-sectional view of the apparatus of FIG. 1, shown in a collapsed configuration.

As illustrated in FIGS. 1–3, a load-bearing, pressurized-fluid column apparatus, indicated generally at 10, in accordance with the present invention is shown for supporting a load 14 with respect to a support surface 18. Mining is an example of one field that may benefit from the use of such an apparatus 10. Thus, the load 14 can be the force of an overhead ceiling in a mine, while the support surface 18 can be the floor underneath the load 14 in the mine. As described above, it will be appreciated that mining removes material leaving the material, load or ceiling above it without support. The apparatus 10 is shown in the drawings and described herein configured for use in mining. It will of course be understood that such an apparatus can be configured for use in other fields.

The column apparatus 10 extends between the load 14 and support surface 18 to resist relative movement between the load 14 and the support surface 18, or to resist displacement of the load 14 towards the support surface 18. A first or base end of the column apparatus 10 abuts the support surface 18 or ground, while a second or cap end abuts the load 14 or ceiling. Thus, the column apparatus 10 can support the load 14 or the ceiling of the mine.

The column apparatus 10 includes a flexible sleeve 22 that retains an incompressible liquid 26. In one aspect, the incompressible liquid 26 can be pressurized and can fill the sleeve 22. While either the liquid or the flexible sleeve alone are incapable of providing support due to their respective liquid or flexible nature, the sleeve 22 with the liquid 26 contained therein together form a rigid column capable of resisting an applied load.

The flexible sleeve 22 advantageously has at least two configurations, including a first collapsed, unused, and/or transportable configuration, as shown in FIG. 3, and a second expanded, in-use, and/or load-bearing configuration, as shown in FIGS. 1 and 2. Referring to FIG. 3, in the first configuration, the sleeve 22 or column apparatus 10 has a first, shorter length. In addition, the sleeve 22 can be collapsed or folded upon itself, and thus has a smaller volume which is substantially unfilled or void of the liquid 26. It will be appreciated that in the first configuration, the column apparatus 10 is smaller and weighs less, thus facilitating transport of the column apparatus 10, especially into a mine.

Referring to FIGS. 1 and 2, in the second configuration, the sleeve 22 or column apparatus 10 has a second, longer length that is sized to extend to the load 14 and to the support surface 18. In the second configuration, the first, lower or base end of the apparatus 10 abuts the support surface 18, while the second, upper or cap end abuts the load 14 or ceiling. In addition, the sleeve 22 is expanded and filled with the liquid 26 so that the flexible sleeve 22 and the fluid 26 form a rigid column to resist the load 14. The sleeve 22 and the column apparatus 10 have a longitudinal axis along the length thereof, and along which the sleeve 22 expands and/or collapses.

In one aspect, the flexible sleeve 22 is formed of a flexible and high-strength material configured to withstand high-tension loads. The material can include a woven fabric material with threads of high tension strength. The sleeve 22 can be formed by wrapping a sheet of the material into a sleeve or cylindrical shape. The sheet can be attached to itself, or edges thereof can be attached, to retain the shape. For example, the sheet or the edges can be attached by an adhesive. In one aspect, the sleeve 22 can include a plurality of layers of the material. For example, the sleeve 22 can be formed by wrapping a single continuous sheet of the material around itself one or more times to form the multiple layers. The multiple layers of material bear against one another and provide a frictional force that resists unwrapping of the sheet. In addition, the sheet or edge thereof can be attached to itself to resist unwrapping. In one aspect, the sleeve 22 has a circular cylindrical shape in the second, load-bearing configuration to evenly distribute pressure in the sleeve 22, and to provide hoop-stress circumferentially around the sleeve 22, as discussed below. In addition, the sleeve 22 can be formed as a continuous weave so that there is no seem.

Figure 4:
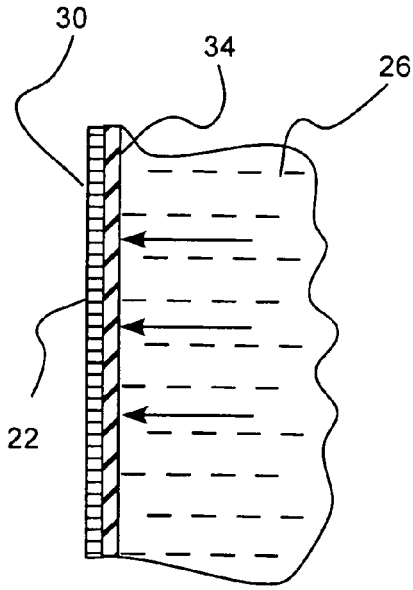
FIG. 4 is a partial, cross-sectional detailed view of a portion of a sleeve of the apparatus of FIG. 1.

In addition, the sleeve 22 or material forming the sleeve can be liquid resistant or liquid impervious. Referring to FIG. 4, the sleeve 22 can include an outer layer 30 formed by the high-strength material, and an inner layer or bladder 34. The outer layer 30 can provide strength to resist pressure in the sleeve, while the inner layer or bladder 34 contains the fluid. The bladder 34 can be formed of a flexible, liquid impervious material, such as plastic or rubber.

As described above, the liquid 26 is substantially incompressible. The liquid 26 can be, for example, water or the like. Water is preferred as mines typically have a source or pressurized water. It is believed that incompressible liquids, such as water, are preferable to compressible fluids or gases, such as air, for safety reasons. It is believed that any unintentional puncture or rupture of the column apparatus will be less violent, or have less energy, with water than with a compressed gas. Additives or chemicals can be added to the water to resist corrosion, leakage, etc.

Referring again to FIGS. 1 and 2, the column apparatus 10 can include a base 38, and/or a cap 42. The base 38 is coupled to the first or lower end of the sleeve 22, and is disposed on, or abuts, the support surface 18. Likewise, the cap 42 is coupled to the second or upper end of the sleeve 22, and abuts the load 14 or ceiling. The base 38 and the cap 42 can seal the ends of the sleeve 22 so that together, the sleeve 22, the base 38 and the cap 42 form an enclosure to contain the liquid 26. The enclosure, sleeve 22, and/or column apparatus 10 extends between the load 14 and the base support 18, and thus can be elongated with a longitudinal axis parallel to a direction of a force of the load 14, or perpendicular to the ceiling and support surface 18.

The base 38 and the cap 42 can have plates 46 and 50 to bear against the support surface 18 and load 14. In one aspect the plates 46 and 50 are substantially planer or flat. As stated above, the sleeve 22 can be circular. Thus, the base 38 and the cap 42 can have circular receptacles to receive the ends of the sleeve 22 therein. The receptacles can include an outer annular wall or rim 54 extending from the plate 46 or 50 into which the sleeve 22 is received. The base 38 and the cap 42, or the plates 46 and 50, provide stability to the sleeve 22.

Figure 5:
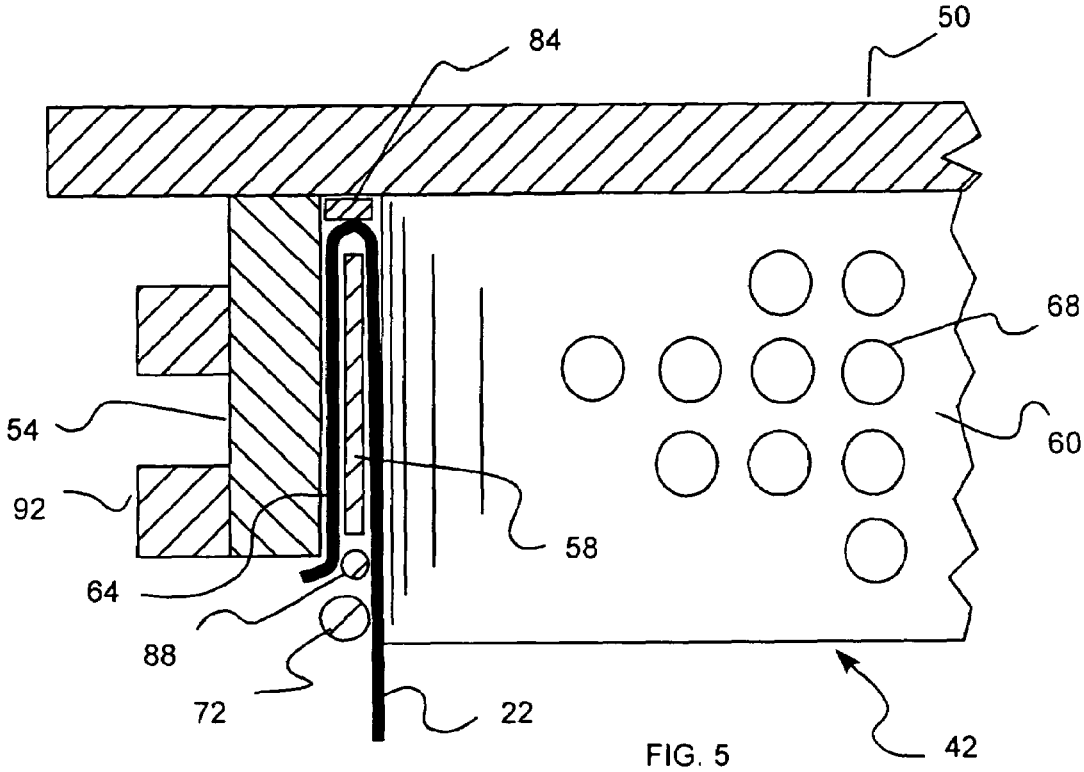
FIG. 5 is a cross-sectional view of a cap of the apparatus of FIG. 1.

Referring now to FIG. 5, the second or upper end of the sleeve 22 can be fixedly coupled to the cap 42. The second or upper end of the sleeve 22 can be wrapped around a ring 58 and inserted into the receptacle or outer annular wall 54. Pressure within the enclosure or sleeve 22 is utilized to press the sleeve 22 against the ring 58, and thus press the folded portion of the sleeve against the annular wall 54. Thus, the pressure causes the folded portion of the sleeve to be pinched between the ring 58 and the annular wall 54 to secure the sleeve 22 to the cap 42.

In addition, an inner annular wall 60 can extend from the plate 50, forming an annular gap 64 or slot between itself and the outer annular wall 54. The gap 64 can be sized to produce an interference fit with the ring 58 and sleeve 22 folded thereabout. One or more apertures 68 can be formed in the inner annular wall 60 to allow the pressure of the fluid to act upon the ring 58 and sleeve 22. The inner annular wall 60 can extend a greater distance beyond the outer annular wall 54. Thus, an annular fastener 72 can be tightened around the sleeve 22 and an extended portion of the inner annular wall 60 to secure the sleeve 22 to the wall 60 during lower pressure. The annular fastener 72 can be an elastic cord, an adjustable ring, etc.

Figure 6:
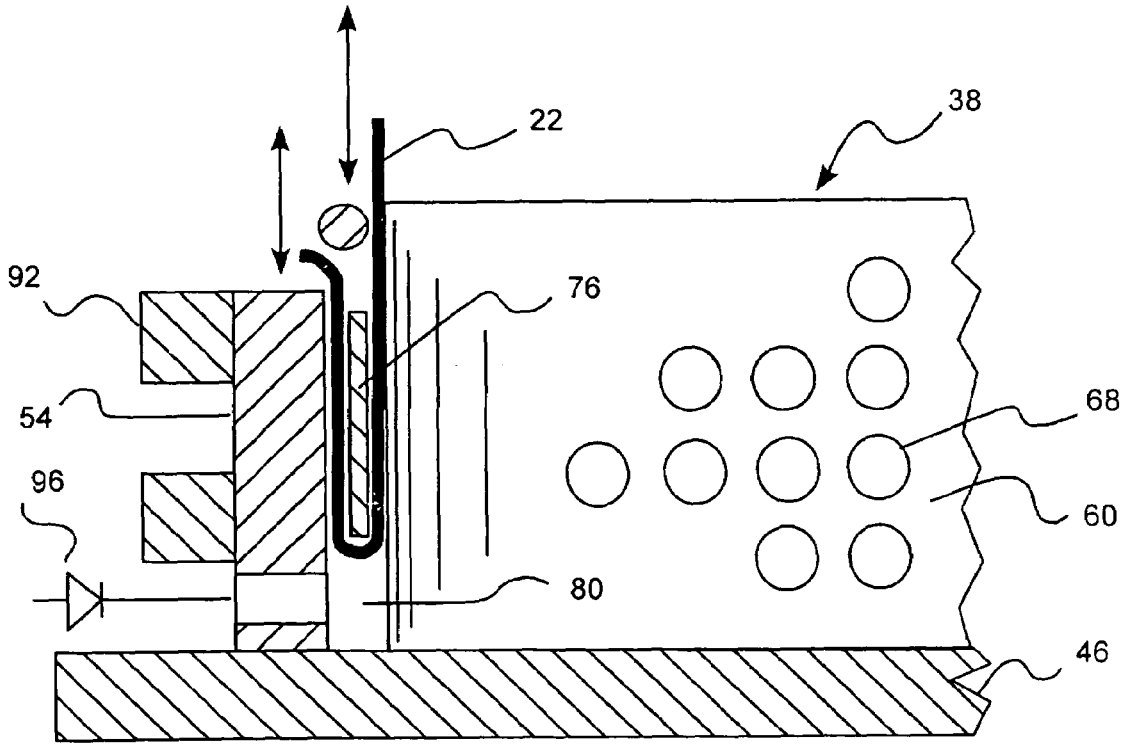
FIG. 6 is a cross-sectional view of a base of the apparatus of FIG. 1.
Figure 7:
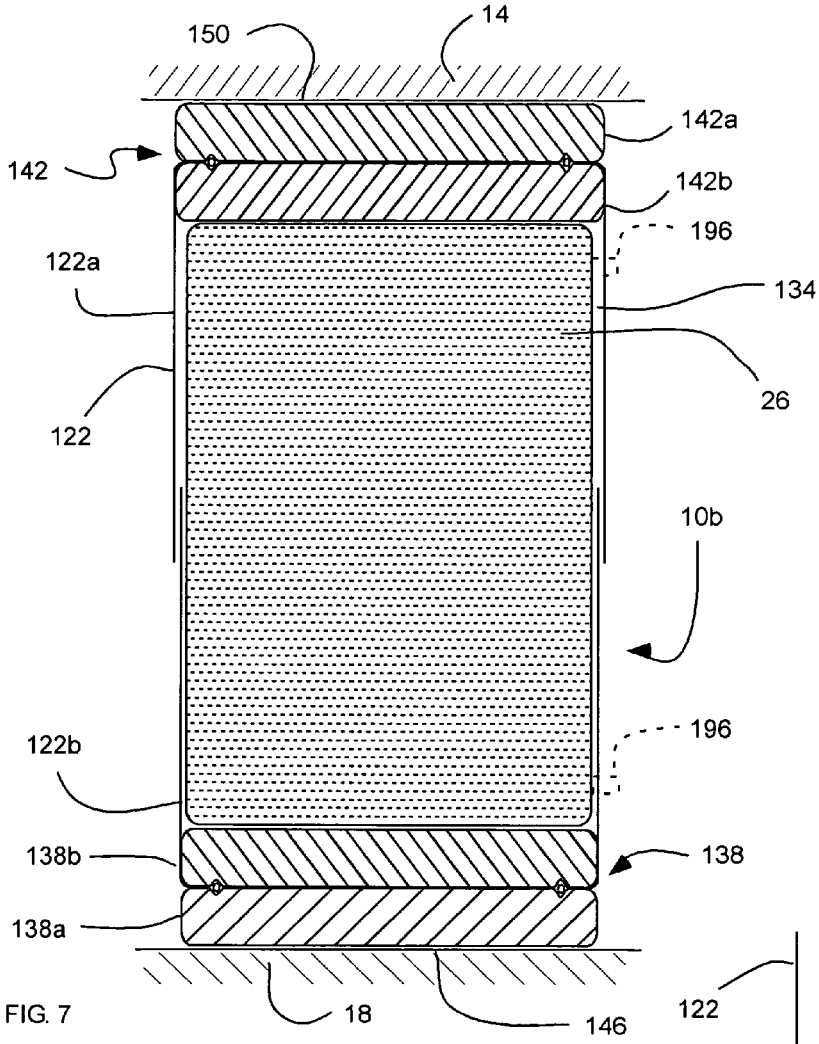
FIG. 7 is a cross-sectional side view of another load-bearing column apparatus in accordance with an embodiment of the present invention shown in an expanded configuration supporting a load.

Referring to FIG. 6, the first or lower end of the sleeve 22 advantageously can be adjustably coupled to the base 38. Therefore, the length of the sleeve 22, and thus the column apparatus 10, advantageously can be adjusted to extend between the load 14 and the support surface 18. The first or lower end of the sleeve 22 can be removably disposed in the receptacle of the base 38, and selectively coupled thereto. The sleeve 22 can be wrapped around a ring 76 that also is removably disposed in the annular wall 54 of the base 38. Like the cap 42 (FIG. 5), the base 38 can include an inner annular wall 60 forming a gap 80 between itself and the outer annular wall 54. The gap 80 is sized so that the ring 76 with the sleeve 22 wrapped therearound can be selectively slid into and out of the gap 80. To adjust the length of the sleeve 22 and/or column apparatus 10, the sleeve 22 is wrapped around the ring 76 and the ring 76 positioned along a length of the sleeve 22 to achieve the desired length.

It is of course understood that on or both ends of the sleeve 22 can be fixedly attached to the cap 14 and the base 18, as described above and illustrated in FIG. 5, so that the sleeve 22 and the column apparatus 10 has a fixed length. Similarly, it will be understood that one or both ends of the sleeve 22 can be adjustably coupled to the cap 14 and the base 18, as described above and illustrated in FIG. 6, so that the sleeve 22 and column apparatus 10 can have an adjustable length. In addition, it is understood that the ends of the sleeve 22 can be coupled to the cap 14 and base 18 in any appropriate manner.

Referring again to FIG. 5, additional seals can be provided to resist leaking between the sleeve 22 and the cap 42 or base 38 (FIG. 6). For example, a seal 84 can be positioned in the bottom of the gap 64 or 80 (FIG. 6). Similarly, a seal 88 can be positioned in the top of the gap 64 or 80 (FIG. 6). The seals can be of any appropriate type, such as, for example, o-rings, etc. In addition, the cap 42 and/or base 38 (FIG. 6) can include reinforcement rings 92 formed around the outer annular wall 54 to reinforce the wall.

Referring to FIGS. 1, 2 and 6, the column apparatus can include a valve 96 for selectively allowing the fluid 26 into the sleeve 22. In one aspect, the valve 96 is operatively coupled to the base 18. The valve 96 can be an inlet valve, or both an inlet and an outlet valve, and can be of any appropriate type, including for example, a check valve, ball valve, gate valve, etc. In addition, the column apparatus 10 can include an emergency pressure release valve 100 configured to automatically release the fluid 26 upon reaching a predetermined pressure. Thus, the release valve 100 resists catastrophic failure of the apparatus.

Referring again to FIG. 1, the column apparatus 10 can include one or more rods or cables 104 extending between the base 38 and the cap 42 to limit the longitudinal extension or length of the apparatus 10. The rod or cable 104 can be coupled to the plates 46 and 50 of the base 38 and cap 42. A plurality of such rods or cables 104 spaced around the sleeve 22 can help maintain the plates 46 and 50 in a parallel relationship, and improve the stability of the apparatus. The rods or cables are examples of a means for limiting longitudinal extension of the sleeve. It is of course understood that the rods or cables can be adjustable in length, or adjustably coupled to the base and cap.

Referring again to FIGS. 1–3, the column apparatus 10 advantageously utilizes the flexible and high-strength sleeve 22 and incompressible fluid 26 to provide a collapsible, load-bearing structure. The flexibility of the sleeve 22 and the fluid nature of the liquid 26 allow the column apparatus 10 to be collapsible to a smaller, lighter, flexible configuration for transportation, and expandable to a larger, load-bearing, rigid structure. As described above, while neither the flexible sleeve 22 or liquid 26 alone provides support or resists the load, together the sleeve 22 with the liquid 26 contained therein form a rigid, load-bearing structure capable of supporting the load 14, or resisting movement thereof.

It will be appreciated that the load 14 exerts a load force, indicated by arrow 108, substantially along the longitudinal axis of the column apparatus 10 or sleeve 22. The liquid 26 in the sleeve 22 can be pressurized, thus exerting a column force, indicated by arrows 112, outwardly on the sleeve 22 and the base and cap 38 and 42, or plates 46 and 50 thereof. The liquid 26 can be pressurized from a liquid source that is also pressurized, and/or the force 108 from the load also can act to pressurize the liquid 26. The column force 112 and/or pressure exerted on the sleeve 22 causes hoop-strain in the sleeve or material thereof, and causes the sleeve 22 to become rigid. In addition, the column force 112 acts against the load force 108 from the load 14.

It also will be appreciated that the magnitude of the column force 112 to resist the load force 108 will depend on the configuration of the column apparatus 10 and the pressure of the liquid 26. For example, the column force will be equal to the pressure of the fluid 26 over the area, such as the plate 50, which the pressure acts, or F=PA. Therefore, the column apparatus 10, or sleeve 22, cap 42 or plate 50, can be sized, and the pressure of the liquid 26 deter-mined, to resist an anticipated load force 108. It is anticipated that such a column apparatus 10 or sleeve 22 will have a diameter between approximately 1 to 3 feet, and that the pressure of the liquid 26 will be between approximately 100 to 2000 pounds per square inch (psi). For example, a column with a two foot diameter and a liquid pressure of 1200 psi will be capable of resisting approximately 270 tons (i.e. force=pressure×area=1200 psi×◇/4(2*12)$^2$). In addition, it is anticipated that such a column apparatus 10 or sleeve 22 will have an extended length between approximately 3 to 12 feet. It is understood that such a column could be longer, limited only by buckling. Such a configuration is well suited for use in mining situations.

A method for using the column apparatus 10 described above includes positioning the apparatus 10 or the sleeve 22 in a desired location between the load 14 and the support surface 18. The sleeve 22 preferably is empty, or void of the liquid 26, to facilitate transporting and positioning the apparatus 10. The load 14 or ceiling and the support surface 18 can be prepared beforehand. For example, the support surface 18 and the ceiling may be flattened and/or leveled. The first plate 46 of the base 38 can be positioned to abut, or to be disposed on, the support surface 18. In addition, wedges or shims can be placed between the cap or base and the respective ceiling or floor.

The incompressible liquid 26 can be introduced into the sleeve 22 to lengthen or expand the sleeve 22 to extend between the load 14 and the support surface 18. The sleeve 22 can be filled with the liquid 26. The liquid 26 can be introduced through the valve 96. The valve may be opened to allow the liquid to pass therethrough. The liquid 26 can be introduced from a liquid source, such as a pressurized liquid source. Thus, the liquid 26 in the sleeve 22 also can be pressurized. In addition, the second plate 50 of the cap 42 is positioned to abut the load 14 or ceiling. The valve 96 can then be closed to prevent escape of the liquid.

As discussed above, the ends of the sleeve 22 can be secured to the first and second plates, or the base and the cap 38 and 42, so that the sleeve is sealed. The distance between the load 14 and the support surface 18 can be measured, and the length of the sleeve 22 adjusted to fit therebetween prior to filling the sleeve 22. One end of the sleeve 22 can be pulled through the ring 76 until the sleeve 22 has the desired length. The ring 76 can then be inserted into the base 38.

In the first, collapsed configuration, as shown in FIG. 3, the sleeve 22 may be folded and disposed in the cap 42 and the base 38 so that the cap and the base form a container containing the sleeve. Such a configuration can assist in transporting the apparatus.

A plurality of such columns can be positioned adjacent one another in an array to form a wall.

Referring to FIGS. 7–9*b*, another load-bearing, pressurized-fluid column apparatus 10*b* in accordance with the present invention is shown for supporting a load 14 with respect to a support surface 18. The column apparatus 10*b* is similar in many respects to that described above. Thus, the description above is equally applicative to the present embodiment, so some aspects will not be repeated.

The column apparatus 10*b* includes a flexible sleeve 122 and bladder 134 that retain the incompressible liquid 26. The sleeve 122 can be a sleeve assembly, and can include two telescoping sleeves 122*a* and 122*b*, or two sleeves that are telescopically engaged. The sleeves 122*a* and 122*b* include an overlapping portion so that the bladder 134 is surrounded by the sleeve. Thus, the sleeve 122 can adjust to different heights, or different distances between the support surface 18 or floor of the mine and the load 14 or overhead ceiling of the mine. The bladder 134 is disposed in the sleeve 122. In one aspect, the incompressible liquid 26 can be pressurized and can fill the bladder 134, and the sleeve 122. While either the liquid or the flexible sleeve and bladder alone are incapable of providing support due to their respective liquid or flexible nature, the sleeve 122 and bladder 134 with the liquid 26 contained therein together form a rigid column capable of resisting an applied load. The sleeve 122 can provide strength to resist pressure in the bladder, while the bladder 134 contains the fluid. The bladder 134 can be formed of a flexible, liquid impervious material, such as plastic or rubber.

The flexible sleeve 122 can be formed of a flexible and high-strength material configured to withstand high-tension loads. The material can include a woven fabric material with threads of high tension strength. The sleeve 122 can be formed by wrapping a sheet of the material into a sleeve or cylindrical shape. The sheet can be attached to itself, or edges thereof can be attached, to retain the shape. For example, the sheet or the edges can be attached by an adhesive. In one aspect, the sleeve 122 can include a plurality of layers of the material. For example, the sleeve 122 can be formed by wrapping a single continuous sheet of the material around itself one or more times to form the multiple layers. The multiple layers of material bear against one another and provide a frictional force that resists unwrapping of the sheet. In addition, the sheet or edge thereof can be attached to itself to resist unwrapping. In one aspect, the sleeve 122 has a circular cylindrical shape in the second, load-bearing configuration to evenly distribute pressure in the sleeve 122, and to provide hoop-stress circumferentially around the sleeve 122. In addition, the sleeve 22 can be formed as a continuous weave so that there is no seem.

The flexible sleeve 122 and bladder 134 advantageously have at least two configurations, including a first collapsed, unused, and/or transportable configuration, and a second expanded, in-use, and/or load-bearing configuration. In the first configuration, the sleeve 22 or column apparatus 10*b* has a first, shorter length. In addition, the sleeve 122 can be collapsed or folded upon itself, and thus has a smaller volume which is substantially unfilled or void of the liquid 26. It will be appreciated that in the first configuration, the column apparatus 10*b* is smaller and weighs less, thus facilitating transport of the column apparatus 10*b*, especially into a mine. In the second configuration, the sleeve 122 or column apparatus 10*b* has a second, longer length that is sized to extend to the load 14 and to the support surface 18. In the second configuration, the first, lower or base end of the apparatus 10*b* abuts the support surface 18, while the second, upper or cap end abuts the load 14 or ceiling. In addition, the sleeve 122 and bladder 134 are expanded and filled with the liquid 26 so that the flexible sleeve 122, bladder 134 and the fluid 26 form a rigid column to resist the load 14.

The column apparatus 10*b* can include a base 138, and/or a cap 142. The base 138 is coupled to the first or lower end of the sleeve 122 (or lower sleeve 122*b*), and is disposed on, or abuts, the support surface 18. Likewise, the cap 142 is coupled to the second or upper end of the sleeve 122 (or upper sleeve 122*a*), and abuts the load 14 or ceiling. The base 138 and the cap 142 can seal the ends of the sleeve 122 so that together, the sleeve 122, the base 138 and the cap 142 form an enclosure to contain the bladder 134.

The base 138 and the cap 142 can have plates 146 and 150 to bear against the support surface 18 and load 14. In one aspect the plates 146 and 150 are substantially planer or flat. As stated above, the sleeve 122 can be circular. Thus, the base 138 and the cap 142 can be circular. The base 138 and the cap 142, or the plates 146 and 150, provide stability to the sleeve 122. The base 138 and cap 142 can include outer plates 138*a* and 142*a* and inner plates 138*b* and 142*b*. The ends of the sleeve 122 can be sandwiched between the inner and outer plates 138*a* and *b*, and 142*a* and *b*. Thus, the base 138 has opposing plates 138*a* and *b*, while the cap 142 has opposing plates 142*a* and *b*.

The inner and outer plates can include an annular groove 144 formed between the plates. The groove 144 can be formed in both plates, as shown, or in one of the opposing plates. A ring 147 can be disposed in the annular groove 144, in both the base 138 and cap 142. The ends of the sleeve 122 can extend between the opposing plates, around the ring, and back, either terminating between the plates, or extending back out between the plates. Pressure within the enclosure or bladder 134 is utilized to press the inner plates 138*a* and 142*a* against the outer plates 142*a* and 142*b*, and thus pinch the sleeve 122 between the plates. In addition, the ring 147 is captured in the groove 144, and resists the sleeve from being pulled out from between the plates. Furthermore, the end of the sleeve can be enlarged to further resist slipping between the plates. The plates can be wood and the rings can be steel rings or rope.

The column apparatus 10*b* can include one or more valves 196 for selectively allowing the fluid 26 into the sleeve 122. In one aspect, the valve can extend through the sleeve 122 and bladder 134. In another aspect, the valve 196 can be operatively coupled to the base 138 or cap 142. The valve 196 can be an inlet valve, or both an inlet and an outlet valve, and can be of any appropriate type, including for example, a check valve, ball valve, gate valve, etc. In addition, the column apparatus 10*b* can include an emergency pressure release valve configured to automatically release the fluid 26 upon reaching a predetermined pressure.

Figure 9A:
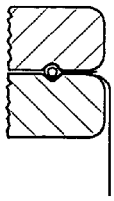
FIG. 9*a* is a partial cross-sectional view of the column apparatus of FIG. 7.
Figure 9B:
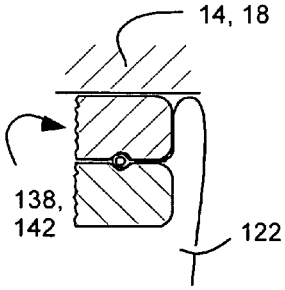
FIG. 9*b* is a partial cross-sectional view of the column apparatus of FIG. 7 with the base or cap compressed into the sleeve.
Figure 8:
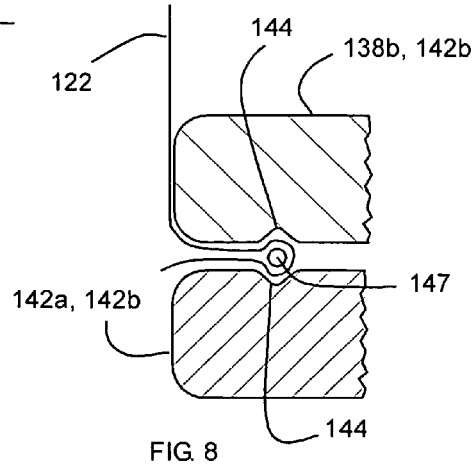
FIG. 8 is a partial cross-sectional exploded view of the column apparatus of FIG. 7.

The base 138 and cap 142 can have a diameter that is less than a diameter of the sleeve 122. Thus, the sleeve 122 resists rubbing on the plates 138*a* and 142*b*. In addition, the base and cap 138 and 142 can extend into the bottom and top of the sleeve 122, as shown in FIG. 9*b*, during movement of the ceiling or load 14, with heavy convergence, or even "mountain bounces." It will be appreciated that the convergence of the ceiling and floor results in a pressure increase and/or volume decrease. Thus, the sleeve and bladder can receive the cap and/or base during convergence, and the sleeve and bladder can expand around the cap and/or base.

The column apparatus 10*b* advantageously utilizes the flexible and high-strength sleeve 122, bladder 13 and incompressible fluid 26 to provide a collapsible, load-bearing structure. The flexibility of the sleeve 122 and bladder 134 and the fluid nature of the liquid 26 allow the column apparatus 10*b* to be collapsible to a smaller, lighter, flexible configuration for transportation, and expandable to a larger, load-bearing, rigid structure. As described above, while neither the flexible sleeve 122 and bladder 134 or liquid 26 alone provides support or resists the load, together the sleeve 122 and bladder 134 with the liquid 26 contained therein form a rigid, load-bearing structure capable of supporting the load 14, or resisting movement thereof.

A method for using the column apparatus 10*b* described above includes positioning the apparatus in a desired location between the load 14 and the support surface 18. The sleeve 122 or bladder 134 preferably is empty, or void of the liquid 26, to facilitate transporting and positioning the apparatus 10*b*. The incompressible liquid 26 can be introduced into the bladder 134 to lengthen or expand the sleeve 122 to extend between the load 14 and the support surface 18. As the bladder 134 fills, the sleeves 122*a* and 122*b* can slide with respect to one another.

A plurality of such columns can be arranged in an array, and intercoupled together or fluidly coupled together, so that the plurality of columns act together and pressure stabilize one another.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A load-bearing column apparatus configured to support a load with respect to a support surface, the apparatus comprising:

a) a base configured to abut the support surface;

b) a cap configured to abut the load;

c) an elongated, flexible sleeve extending between the cap and the base to form an enclosure configured to extend to and between the load and the support;

d) a bladder, disposed in the enclosure configured to selectively receive an incompressible liquid;

e) the elongated, flexible sleeve having at least two configurations, including:

i) a collapsed configuration in which the bladder is not filled and has a first, shorter length; and ii) an expanded configuration in which the bladder is filled with the liquid and has a second, longer length sized to extend to and between the load and the support surface;

f) the cap or the base including a pair of plates including an outer plate and an inner plate;

g) an annular groove, formed between the outer plate and the inner plate; and h) a ring, disposed in the annular groove between the outer plate and the inner plate, an end of the sleeve extending around the ring.

2. An apparatus in accordance with claim 1, wherein the outer plate and the inner plate are upper and lower plates disposed one above, another; and wherein the annular groove extends into a surface of at least one of the outer plate and the inner plate.

3. An apparatus in accordance with claim 1, wherein the sleeve has a greater diameter than a diameter of the base or the cap; and wherein the base or the cap is displaceable into the sleeve.

4. An apparatus in accordance with claim 1, wherein the sleeve includes a pair of sleeves that telescopically engage one another with one sleeve coupled to the base and another sleeve coupled to the cap.

5. An apparatus in accordance with claim 1, further comprising:

a valve to allow the liquid to be added to the bladder and prevent escape of the liquid from the sleeve.

6. An apparatus in accordance with claim 1, wherein the sleeve and bladder further comprise:

a) a flexible, high strength woven fabric configured to withstand high tension loads; and b) a flexible, liquid impervious layer configured to contain liquid.

7. An apparatus in accordance with claim 1, wherein the sleeve has a circular, cylindrical shape in the expanded configuration configured to withstand tension loads.

8. An apparatus in accordance with claim 1, further comprising:

means for limiting longitudinal extension of the sleeve.

9. An apparatus in accordance with claim 1, further comprising:

at least one of the ends of the sleeves being adjustable coupled to either the cap or the base to selectively adjust the length of the sleeve and the distance between the cap and the base.

10. A load-bearing column apparatus configured to support a load with respect to a support surface, the apparatus comprising:

a) a base configured to abut the support surface including an upper plate and a lower plate;

b) a cap configured to abut the load including an upper plate and a lower plate;

c) at least one elongated, flexible sleeve extending between the cap and the base to form an enclosure, an end of the sleeve extending between the upper and lower plates of at least one of the base or the cap; and d) a bladder, disposed in the enclosure configured to selectively receive an incompressible liquid.

11. An apparatus in accordance with claim 10, wherein the elongated, flexible sleeve and bladder have at least two configurations, including:

i) a collapsed configuration in which the bladder is not filled and has a first, shorter length; and ii) an expanded configuration in which the bladder is filled with the liquid and has a second, longer length sized to extend to and between the load and the support surface.

12. An apparatus in accordance with claim 10, wherein the outer plate and the inner plate are upper and lower plates disposed one above another; and further comprising an annular groove extending into a surface of at least one of the outer plate and the inner plate, and a ring disposed in the annular groove between the outer plate and the inner plate, an end of the sleeve extending around the ring.

13. An apparatus in accordance with claim 10, wherein the sleeve has a greater diameter than a diameter of the base or the cap; and wherein the base or the cap is displaceable into the sleeve.

14. An apparatus in accordance with claim 10, wherein the sleeve includes a pair of sleeves that telescopically engage one another with one sleeve coupled to the base and another sleeve coupled to the cap.

15. An apparatus in accordance with claim 10, further comprising:

a valve to allow the liquid to be added to the bladder and prevent escape of the liquid from the sleeve.

16. An apparatus in accordance with claim 10, wherein the sleeve and bladder further comprise:

a) a flexible, high strength woven fabric configured to withstand high tension loads; and b) a flexible, liquid impervious layer configured to contain liquid.

17. An apparatus in accordance with claim 10, further comprising:

at least one of the ends of the sleeves being adjustable coupled to either the cap or the base to selectively adjust the length of the sleeve and the distance between the cap and the base.

18. A load-bearing column apparatus configured to support a load with respect to a support surface, the apparatus comprising:

a) a base configured to abut the support surface;

b) a cap configured to abut the load;

c) an elongated, flexible sleeve extending between the cap and the base to form an enclosure configured to extend to and between the load and the support;

d) a bladder, disposed in the enclosure configured to selectively receive an incompressible liquid;

e) the elongated, flexible sleeve having at least two configurations, including:

i) a collapsed configuration in which the bladder is not filled and has a first, shorter length; and ii) an expanded configuration in which the bladder is filled with the liquid and has a second, longer length sized to extend to and between the load and the support surface;

f) the cap or the base including a pair of plates including an outer plate and an inner plate; and g) an end of the sleeve extending between the outer and inner plates.

19. An apparatus in accordance with claim 18, wherein the outer plate and the inner plate are upper and lower plates disposed one above another; and wherein the flexible sleeve extends into a surface of at least one of the outer plate and the inner plate.

20. An apparatus in accordance with claim 18, wherein the sleeve has a greater diameter than a diameter of the base or the cap; and wherein the base or the cap is displaceable into the sleeve.

* * * * *